US008322267B2

(12) United States Patent
Altergott et al.

(10) Patent No.: US 8,322,267 B2
(45) Date of Patent: Dec. 4, 2012

(54) ARMOR REPAIR KIT AND METHODS RELATED THERETO

(75) Inventors: William Altergott, Uxbridge, MA (US); Thomas J. Carroll, Salem, NH (US); James J. Gorman, Boxborough, MA (US); George Santiago, Marlborough, MA (US)

(73) Assignee: Triton Systems, Inc., Chelmsford, MA (US)

( * ) Notice: Subject to any disclaimer, the term of this patent is extended or adjusted under 35 U.S.C. 154(b) by 586 days.

(21) Appl. No.: 12/477,355

(22) Filed: Jun. 3, 2009

(65) Prior Publication Data

US 2009/0293711 A1 Dec. 3, 2009

Related U.S. Application Data

(60) Provisional application No. 61/058,331, filed on Jun. 3, 2008.

(51) Int. Cl.
*F41H 5/02* (2006.01)

(52) U.S. Cl. ..... 89/36.02; 29/402.09

(58) Field of Classification Search ..... 29/402.09, 29/402.12, 402.18; 89/36.02
See application file for complete search history.

(56) References Cited

U.S. PATENT DOCUMENTS

| | | | | |
|---|---|---|---|---|
| 1,463,498 | A | | 7/1923 | Burgess |
| 3,324,768 | A | | 6/1967 | Eichelberger |
| 3,431,818 | A | | 3/1969 | King |
| 3,523,057 | A | | 8/1970 | Buck |
| 3,705,558 | A | | 12/1972 | McDougal et al. |
| 3,765,299 | A | | 10/1973 | Pagano et al. |
| 4,179,979 | A | | 12/1979 | Cook et al. |
| 4,497,755 | A | * | 2/1985 | Korsyn ..... 264/1.7 |
| 4,665,794 | A | | 5/1987 | Gerber et al. |
| 4,895,063 | A | | 1/1990 | Marlow et al. |
| 4,945,814 | A | | 8/1990 | Huet |
| 5,063,006 | A | * | 11/1991 | Tahara ..... 264/35 |
| 5,134,725 | A | | 8/1992 | Yeshurun et al. |
| 5,259,549 | A | | 11/1993 | Loew et al. |
| 5,364,679 | A | | 11/1994 | Groves |
| 5,388,317 | A | * | 2/1995 | Johansen et al. ..... 29/402.18 |
| 5,736,474 | A | | 4/1998 | Thomas |
| 5,738,925 | A | | 4/1998 | Chaput |
| 5,756,922 | A | | 5/1998 | Fuller |
| 5,969,078 | A | | 10/1999 | Freeman |
| 6,112,635 | A | | 9/2000 | Cohen |
| 6,203,908 | B1 | | 3/2001 | Cohen |
| 6,289,781 | B1 | | 9/2001 | Cohen |
| 6,408,734 | B1 | | 6/2002 | Cohen |

(Continued)

FOREIGN PATENT DOCUMENTS

WO WO2009/149170 B1 12/2009

OTHER PUBLICATIONS

Dean, Helmets and Body Armor in Modern Warfare, *New Haven: Yale University Press*, (1920), Introduction and Chapter VII, 282-293.

(Continued)

*Primary Examiner* — Jeanette E Chapman
*Assistant Examiner* — Daniel Kenny
(74) *Attorney, Agent, or Firm* — Pepper Hamilton LLP

(57) ABSTRACT

An armor repair kit including repair putty and a scrim having a plurality of ceramic constituents attached thereto and methods for using a repair putty, scrims and kits to repair damaged armor are described herein.

11 Claims, 8 Drawing Sheets

U.S. PATENT DOCUMENTS

| | | | | |
|---|---|---|---|---|
| 6,532,857 | B1 | 3/2003 | Shih et al. | |
| 6,575,075 | B2 | 6/2003 | Cohen | |
| 6,826,996 | B2 | 12/2004 | Strait | |
| 6,920,817 | B2 | 7/2005 | Ravid et al. | |
| 7,261,945 | B2 | 8/2007 | Biermann et al. | |
| 7,513,275 | B2 * | 4/2009 | Lazzara | 138/99 |
| 2001/0008161 | A1 * | 7/2001 | Kociemba et al. | 156/94 |
| 2003/0192426 | A1 | 10/2003 | Peretz | |
| 2009/0293711 | A1 | 12/2009 | Altergott et al. | |
| 2011/0158807 | A1 * | 6/2011 | Hong | 416/61 |

OTHER PUBLICATIONS

Thomas, An Overview of Industrial Fabric Ballistic Protection for Police and Military Personnel, *Auburn University* (Undated).

Ben-Dor et al., Ballistic Impact: Recent Advances in Analytical Modeling of Plate Penetration Dynamics—A Review, *ASME Applied Mechanics Reviews* (Nov. 2005), 58:355-371.

* cited by examiner

ARMOR REPAIR KIT AND METHODS RELATED THERETO

CROSS-REFERENCE TO RELATED APPLICATIONS

This application claims priority under 35 U.S.C. §119(e) to U.S. Provisional Patent Application Ser. No. 61/058,331, filed Jun. 3, 2008, the disclosure of which is incorporated by reference in its entirety.

STATEMENT REGARDING FEDERALLY SPONSORED RESEARCH OR DEVELOPMENT

This invention was made during work supported in part by "Novel Field Repair of Composite Armor", Phase I SBIR Contract No. W56HZV-06-C-0065, Department of the Army, Tank-Automotive Command (TACOM), Warren Mich. 48397-5000; "Novel Field Repair of Composite Armor", Phase II SBIR Contract No. W56HZV-06-C-0576, Department of the Army TACOM, Warren Mich. 48397-5000; and "Armor Repair Kit Prototypes", Contract No. W91CRB-09-C-0017, Department of the Army, U.S. Army RDECOM ACQ CTR, Aberdeen Contracting Division, Combat Operations, Aberdeen Proving Ground, Maryland 21005-3013. The United States Government has certain rights in the invention.

BACKGROUND OF THE INVENTION

1. Field of the Invention

The invention presented herein relates generally to armor repair. More specifically, the present invention relates to a kit with components for performing armor repair on vehicles or other protected structures in the field and/or in local unit facilities, such as a motor pool.

2. Description of Related Art

Armor is often damaged while in service due to hostile attack or accidental action and the compromised ballistic/blast performance of damaged armor puts protected personnel such as police, security or military personnel in danger. Many times, especially in an active military theater of operations, military personnel are forced to either rely on damaged armor or compromise unit readiness levels by de-activating vehicles that are drivable, but have compromised protection levels. This difficult choice is incurred because such hostile or accidental damage occurs, for example, when out on extended patrol, replacement parts for the damaged armor may not be available or because the depot-level maintenance required for repair cannot be immediately scheduled.

Armor can be damaged in various ways through, for example, blast, traffic impacts, hostile ballistic strikes, encounters with mines or improvised explosive devices (IEDs) and/or penetrations. All of these occurrences reduce the level of ballistic or blast performance of the designed protection system. In fact, the reduction in performance level associated with armor damage often results in the scrapping of damaged armor removed from compromised vehicles and the refitting of new armor before the vehicle is returned to service. While replacing damaged armor may provide complete performance recovery, scrapping and refitting armor is costly and does not address the reduction in performance during the time period from when the damage occurs to the repair opportunity. Additionally, vehicles repaired by replacing damaged armor are typically out of service for an extended period of time, which may compromise operational readiness.

Repairing damaged metallic armor generally involves welding processes that utilize resources not readily available to a vehicle crew or unit motor pool. Moreover, gas-welding requires oxygen and volatile compressed fuel sources that can be dangerous to store on a vehicle in a combat situation and arc-welding requires extensive facilities. Welding also exposes armor adjacent to the damaged area to high heat, which may degrade the performance of undamaged armor in the vicinity of the weld repair. In addition, weld repairs are generally difficult for surface geometries that are not flat and include curved profiles, such as, concavities and convexities and/or geometric discontinuities. Further, while welding may be effective for metallic armor repair, it is not applicable to armor systems utilizing advanced composite and ceramic materials.

As such, there remains a need for compositions, kits and methods for repairing damaged armor in the field and in local unit facilities such as motor pools to improve the ballistic/blast performance of the damaged armor, reduce the danger to personnel protected by such armor and improve the operational readiness of the unit(s) to which the armored system is assigned.

SUMMARY OF THE INVENTION

Various embodiments of the invention are directed to an armor repair kit including an armor repair putty comprising a resinous material, one or more scrims having a plurality of ceramic constituents fixedly attached thereto, and an elastomeric housing. In various embodiments, the armor repair kit further comprises a boundary frame and in some embodiments, the boundary frame comprises a conformable material. In certain embodiments, the armor repair kit further comprises a shock-absorbing material layer. In other embodiments, the armor repair kit further comprises a repair disk. In yet other embodiments, the armor repair kit includes hand-held tools for mixing, applying and curing the repair putty. In still other embodiments, the armor repair kit includes a studded sub-frame and slotted sub-frame, wherein portions of the studded sub-frame and portions of the slotted sub-frame are capable of being joined together using a mechanical fastener.

In some embodiments, the armor repair putty further comprises a plurality of ceramic constituents. In other embodiments, the armor repair putty further comprises a plurality of reinforcement fibers. In still other embodiments, the armor repair putty is partially pre-cured.

Various embodiments of the invention are directed to a method for repairing armor including applying a first amount of an armor repair putty comprising a resinous material to a damaged area of armor, applying an elastomeric housing containing one or more scrims having a plurality of ceramic constituents attached thereto and a second amount of armor repair putty over top of the first amount of the armor repair putty, and curing the first and second amounts of armor repair putty. In some embodiments, the method for repairing armor further includes the step of applying a shock-absorbing material layer to the damaged area of armor. In other embodiments of the invention, the method further includes the step of applying a repair disk to the damaged area of armor. In yet others, the method further includes the step of securing a boundary frame to a surface surrounding the damaged area of armor. In still others, the method further comprises the step of cleaning the damaged area of armor. In certain aspects of the invention, the boundary frame includes a conformable material. In other aspects, the elastomeric housing containing the one or more scrims having the plurality of ceramic constituents attached thereto and the second layer of armor repair putty is secured to the boundary frame by a mechanical fastener.

Yet other embodiments of the invention are directed to a method for enhancing non-damaged armor including applying a layer of an armor repair putty comprising a resinous material to an area of armor, applying one or more scrims having a plurality of ceramic constituents attached thereto, filling the interstitial spaces between the ceramic constituents with the armor repair putty, and curing the repair putty. In some embodiments, the repair putty and ceramic-containing scrims may be applied to large surfaces to be protected, foregoing the need to employ a boundary frame and/or flexible housing. In other embodiments, the method further includes securing a boundary frame to a surface surrounding the area of armor. In further embodiments, the method comprises the step of applying a shock-absorbing material layer. In still other embodiments, the method for enhancing non-damaged armor further includes the step of cleaning the area of armor. In yet other aspects of the invention, the one or more scrims having the plurality of ceramic constituents attached thereto are contained in an elastomeric housing.

BRIEF DESCRIPTION OF THE FIGURES

For a fuller understanding of the nature and advantages of the present invention, reference should be made to the following detailed description taken in connection with the accompanying drawings, in which.

DESCRIPTION OF ILLUSTRATIVE EMBODIMENTS

Figure 1:
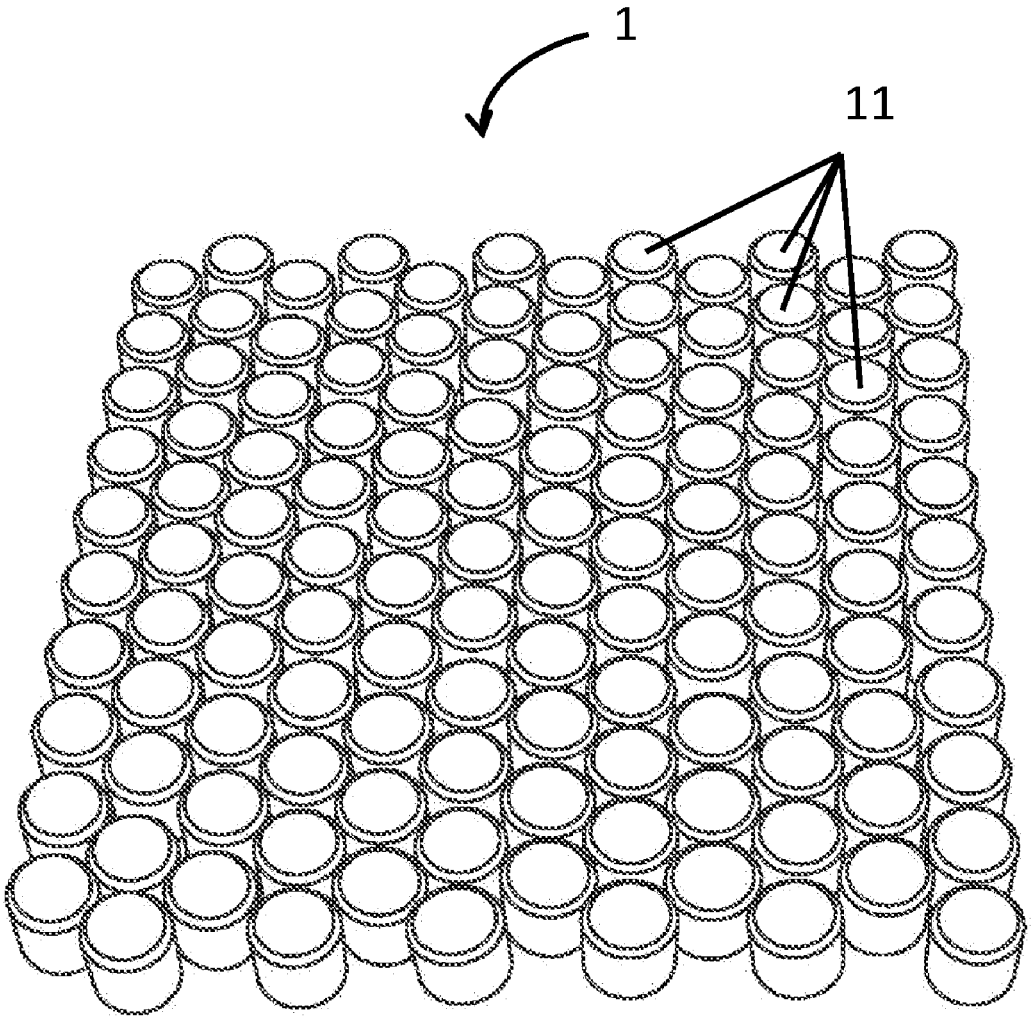
FIG. 1 is a photographic image of an array sheet having end-bonded ceramic nuggets attached to a fiberglass scrim.

This invention is not limited to the particular compositions or methodologies described, as these may vary. In addition, the terminology used in the description describes particular versions or embodiments only and is not intended to limit the scope of the invention. Unless defined otherwise, all technical and scientific terms used herein have the same meanings as commonly understood by one of ordinary skill in the art. In case of conflict, the patent specification, including definitions, will prevail.

As used herein, the singular forms "a", "an" and "the" include plural reference unless the context clearly dictates otherwise.

As used herein, the term "about" means plus or minus 10% of the numerical value of the number with which it is being used. Therefore, about 50% means in the range of 45%-55%.

The terms "include", "comprise" and "have" and their conjugates, as used herein, mean "including but not necessarily limited to."

"Optional" or "optionally" may be taken to mean that the subsequently described structure, event or circumstance may or may not occur, and that the description includes instances where the event occurs and instances where it does not.

The invention presented herein is generally directed to armor repair, methods for repairing armor, and kits including components for repairing armor. Various embodiments of the invention are directed to armor repair putty including a resinous material, reinforcement fibers and ceramic constituents, which may be applied to a damaged area of armor. Various other embodiments of the invention include a scrim, netting or backing, which may be applied to the damaged area prior to the application of the repair putty, and in certain embodiments, a plurality of ceramic aggregates, pellets and/or nuggets may be attached to the scrim, netting or backing. A repair putty, which may or may not contain additional ceramic nuggets or aggregates and/or reinforcement fiber may be spread over the scrim and cured to complete the repair.

Additional embodiments of the invention include a resinous shock-absorbing layer that may be applied to the damaged area prior to the application of the repair putty or scrim. Embodiments of the shock-absorbing layer may be reinforced or unreinforced. Further embodiments of the invention include a conformable boundary frame and/or housing that may be applied to one or more surfaces surrounding a damaged or compromised portion of the armor as an aid in defining the repair geometry and confining the repair putty while it cures. Said boundary frame and/or housing may be applied to the surface being repaired by use of the same resinous material as is employed in the repair putty or by some curable or pressure-sensitive adhesive.

Still further embodiments of the invention are directed to methods for performing repairs to armor using the elements described above, and armor repair kits which may include the components described above along with, for example, a cover sheet and tools for mixing, applying, and/or curing.

The repair putty and/or scrim with or without ceramic nuggets or aggregates may be utilized to repair any type of armor known in the art. Thus, the armor repair kits encompassed by the invention may be used with any armor material such as, for example, metallic armor including aluminum, titanium, steel and other metal alloys, synthetic resinous armor, composite materials, and ceramic plates or tiles, or armor that includes combinations of metallic, resinous, composite and ceramic material elements and the like. In addition, the armor repair kits of the present invention can be used to repair armor with a variety of surface geometries, including, but not limited to, flat horizontal, flat vertical and curved surfaces, as well as overhanging and inverted surfaces.

The repair putty of the present invention may include any type of resinous material known in the art such as, for example, epoxy resins, acrylic resins, acrylonitrile butadiene styrene (ABS) resins, methyl methacrylate (MMA) resins, acetal homopolymer or copolymer resins, polyethylene terephthalate (PET), polyamides such as nylon, vinyl chloride resin, polycarbonates, polyphenylene oxide, polyimide, polyethylene, polypropylene or polystyrene. Generally, the resinous material may be formulated such that the resulting product is a "putty." As used herein, the terms "armor repair putty", "repair putty" and "putty" refer to a flowable, pliable composition having a dough or clay-like consistency that may be cured to a rubbery, hard or dense consistency during the repair process, or may be molded to a hard or dense consistency prior to the repair. In various embodiments, the repair putty is partially pre-cured or pre-cured prior to application. In some embodiments, the resinous material may be formulated to have additional properties, such as, but not limited to strong bonding or enhanced adhesiveness to a variety of surfaces, high strain-to-failure ratio, viscosity sufficient to support application of the putty on vertical and inverted surfaces, sufficient working time after mixing, and minimal curing time. In particular embodiments, the resinous material may include homo or co-polymers including, but not limited to, polyacrylate resins, such as methyl-methacrylate, urethane resin, and epoxy resins; however, other polymer chemistries are also contemplated and may be utilized in context with the invention.

The resinous material of some embodiments may further include additives such as, for example, colorants, UV stabilizers, preservatives, antioxidants, fillers, adhesives, thickeners, polymerization accelerators, crosslinking agents, curing agents and the like. In particular embodiments, curing agents, crosslinking agents and/or polymerization accelerators may be used in conjunction with the resinous material to accelerate curing of such resinous material. Curing agents and polymerization accelerators are well known in the art, and any curing agent or polymerization accelerator appropriate to the particular polymer matrix utilized may be used in conjunction with the armor repair and resinous putties of embodiments of the invention. In other embodiments, fillers such as, for example, fumed silica, may be added to the resinous material to increase its viscosity, thereby increasing the firmness of the putty and facilitating application.

In various embodiments, the resinous material of the repair putty may provide a mechanism by which the components of the repair kit adhere to a surface, such as, for example, undamaged armor surrounding the damaged area or fragments of the damaged armor that remain attached to a vehicle or other protected structure after damage has been inflicted. The resinous material in certain embodiments may be formulated such that the repair putty may adhere to numerous and variable types of material, thereby providing a putty that is capable of attaching or adhering to numerous substrates and that may be applied to dirty, uncleaned and/or unprepared surfaces. Without wishing to be bound by theory, the ability to apply repair putty to an unprepared or dirty surface may save time and minimize effort associated with cleaning debris from the damaged area or otherwise preparing the surface for application. In other embodiments, the resinous material may be formulated such that the repair putty may adhere to numerous and variable surface geometries including, for example, flat horizontal surfaces, flat vertical surfaces, overhanging and inverted surfaces, convex surfaces, concave surfaces or otherwise curved surfaces.

The repair putty of certain embodiments may additionally include reinforcement fibers. The reinforcement fibers utilized in the present invention may be any type of reinforcement fibers known in the art including, for example, chopped-reinforcing fibers, silica fibers, basalt fibers, carbon fibers or polymer fibers such as thermoset polyurethane fibers, polyethylene fibers or para-aramid synthetic fibers, to name a few, or combinations thereof. In such embodiments, reinforcement fibers may make up a relatively low volume fraction of the repair putty, for example, from about 5% to about 10%. In other embodiments, the reinforcement fibers may comprise a larger volume fraction of the repair putty. Without wishing to be bound by theory, reinforcement fibers may enhance the structural integrity of the repair putty during application and/or after curing. For example, reinforcement fibers may improve the properties of the repair putty by, for example, increasing stiffness and load sharing, bridging cracks that may develop, or adding toughness to the resinous material by, for example, improving tear resistance and making the resinous material resistant to cracking and minimizing local strain effects. As such, in some embodiments, reinforcement fibers may allow the repair putty to withstand the impact of a projectile, such as a ballistic projectile or shrapnel fragment, without breaking apart in the absence of any type of woven fiber backing layer. Additionally, in certain embodiments, the reinforcement fibers may restrain ceramic constituents encapsulated in the resinous material to reduce relative motion of the ceramic constituents and thereby improve the penetration resistance of the armor repair putty. Furthermore, the improved toughness of the repair putty incident upon the inclusion of reinforcing fibers may minimize unwanted ejecta and spall associated with a hostile threat strike on the repaired surface.

In various embodiments, ceramic constituents may be encapsulated in the resinous material utilized in the repair putty. As used herein, the term "ceramic constituents" refers to ceramic aggregates, nuggets or any other morphology and may include any ceramic or ceramic composite material known in the art with requisite hardness. The ceramic constituents may absorb ballistic energy from a damaging threat, such as, for example, projectiles, bullets, shrapnel, fragments of metal or composite materials and other objects capable of damaging the armor. In particular embodiments, the ceramic constituents may be mixed into the resinous material of the armor repair putty at a relatively high volume fraction, for example, from about 50% to about 75%. In general, the amount of ceramic constituent provided in the repair putty may be formulated so that the probability of an incoming projectile encountering a ceramic nugget is exceedingly high, and, as such, the volume fraction may vary among embodiments of the invention and may depend, for example, on the material and geometry of the surface to be repaired and the type, size and shape of the ceramic constituent, and the characteristics of expected threat projectiles. For example, in certain embodiments, a repair putty having a relatively high volume fraction of ceramic constituents may be utilized for aspects of armor repair in which repair putty is applied to damaged armor without the use of a backing or scrim layer having ceramic constituents attached. However, in certain embodiments, it may be advantageous to utilize a high volume fraction repair putty incorporating a scrim with previously affixed ceramic aggregates or nuggets. Other embodiments of the invention include repair putties that contain a ceramic constituent volume fraction of less than about 50% of the repair putty, and in particular embodiments, the repair putty may contain no ceramic constituents.

The ceramic constituents of the armor repair putty may minimize a damaging threat in the form of a projectile by deforming, splitting or redirecting the projectile. Under both conventional and unconventional combat conditions, many projectiles typically encountered by armor may be fabricated from steel or soft metals such as, for example, lead or copper. The relative hardness of the ceramic constituents may easily deform or fragment projectiles made of such materials, thereby changing the cross-sectional area of the projectiles and reducing the effectiveness of the projectiles in penetrating the resinous putty material and underlying compromised armor. The ceramic constituent may also split or redirect the projectile providing another mechanism for absorbing the projectile's energy. Without wishing to be bound by theory, redirecting a projectile may change the cross-sectional area along the axis of the original incoming trajectory and redirect the projectile through the material at one or more different trajectories as it passes through the thickness of the repair putty, increasing the penetration path length and absorbing a substantial portion of the projectile's energy. Splitting the projectile combines these mechanisms because a split projectile or fragmented projectile has been deformed, has changed direction, and has created multiple sub-projectiles taking diverse paths through the repair, thus absorbing a significant amount of energy.

The ceramic constituent of the repair putty is generally at least of a size comparable to the diameter of damaging threat or larger, such that the ceramic constituent may impede the progress of the projectile while being restrained in the encapsulating matrix. In some embodiments, the ceramic constituents used in an armor repair putty have a substantially spheroidal diameter of from about ⅛ inch (about 3.2 mm) to about 1½ inches (about 38 mm). In other embodiments, the ceramic constituents have a substantially cylindrical diameter of about ⅛ inch (about 3.2 mm) to about 1½ inches (about 38 mm) and a length of about ¼ (about 6.3 mm) to about 1½ inches (about 38 mm). However, the diameter of the ceramic constituent utilized may vary depending factors such as putty composition, placement of ceramic constituents and intended threat scenario. For example, in some embodiments, for a threat represented by small arms projectiles, the diameter of the ceramic nuggets may range from less than about ¼ inch (about 6.3 mm) to about ½ inch (about 12.7 mm). In other embodiments, ceramic nuggets of about ¾ inch (about 19 mm) to about 1¼ inch (about 32 mm) in diameter may be used for repairs intended to provide protection against larger threat projectiles such as, for example, threat due to the action of improvised explosive devices (IEDs). In still other embodiments of the invention, ceramic constituents of one or more different diameters and/or lengths may be encapsulated in the repair putty in order to effectively block diverse threats.

The ceramic constituents embodied in the invention may be of any shape and contour, for example, the nuggets may have a smooth or more irregular contour; hollow or completely solid; flat, spheroidal, cylindrical or spherical, and so on. The shape and contour of the ceramic constituents may be obtained by any method known in the art, such as, for example, by methods used in the production of grinding and/or polishing media used in tumblers or other industrial finishing applications. In addition, the ceramic constituents of various embodiments may be comprised of any ceramic or ceramic composite material known in the art with requisite hardness. Embodiments of the ceramic material include, but not limited to, alumina, silicon carbide and silicon nitride, among others. In certain embodiments, the ceramic constituents of one or more different materials may be encapsulated in the repair putty.

In particular embodiments of the invention, the repair putty, once cured, may have a specific gravity of from about 2.4 g/cm$^3$ to about 2.8 g/cm$^3$, depending on the specific composition of the repair putty (e.g., the volume fraction of the ceramic constituents or reinforcement fibers and/or the formulation of the resinous material). The macroscopic hardness of the putty may range from about 15 to about 50 on the Shore Hardness D (durometer) scale, while the ceramic nuggets may be relatively much harder. It should be understood that the physical and mechanical properties of the repair putty have a complex relationship with the compositional and processing parameters used in its fabrication and are only qualitatively related to the repair effectiveness. While there may be optimum combinations of putty tear strength, elongation, and stiffness that determine putty effectiveness, these optimum combinations may not represent the maximum values of the individual properties in isolation.

The repair putty used in embodiments of the invention may vary in composition. In particular, the repair putties encompassed by the invention include putties that contain a resinous material without reinforcement fibers and/or ceramic constituents as well as putties that contain a resinous material, reinforcement fibers and/or ceramic constituents or any combination of these elements, and such compositions may be dictated based on the respective use of such putties. For example, in one embodiment, the repair putty may contain only a resinous material. In other embodiments, the repair putty may contain a resinous material and ceramic constituents, but no reinforcement fibers. In still further embodiments, the repair putty may contain a resinous material, ceramic constituents and reinforcement fibers. Any combination of the resinous material, reinforcement fibers and ceramic constituents described herein are encompassed by the invention. In certain embodiments, the putty formulation is varied based on the geometry of the damaged armor surface to be repaired. For example, in some embodiments, a repair putty comprising resinous material, ceramic constituents dispersed randomly throughout such resinous material and reinforcement fibers is utilized in the repair of a curved armor surface. Further, in other embodiments, a flat armor surface is repaired using a putty comprising pre-cured resinous material and ceramic constituents, but no reinforcement fibers.

Various embodiments of the invention include a scrim of a woven or non-woven fabric that may or may not have a plurality of ceramic constituents attached to it. The scrim of such embodiments may be prepared from any material such as, for example, woven or non-woven nylon fibers, polyester fibers, silica fibers, fiberglass fibers, basalt fibers, steel fibers, polymeric fibers, aromatic polyamide fibers, para-aramid synthetic fibers, thermoplastic polyethylene fibers, ultra high molecular weight polyethylene (UHMWPE) fibers, polyethylene fibers, polybenzazole fiber, carbon fibers, graphite fibers, carbon nanotube fibers and combinations thereof In certain embodiments, the scrim may be applied to a damaged area to provide a backing layer or substrate on which the repair putty may adhere. In such a configuration, the scrim may provide not only a backing layer or substrate but also a network that may increase the toughness and structural integrity of the repair putty and reduce cracking, thereby minimizing local strain effects during impact.

In some embodiments, a scrim that does not include ceramic constituents attached to it is used in combination with repair putty comprising a resinous material, ceramic constituents and reinforcement fibers. In other embodiments, a scrim having no ceramic constituents attached to it may be employed in combination with a repair putty that includes a resinous material and ceramic constituents, but no reinforcement fibers. In yet other embodiments, a scrim having no ceramic constituents attached to it may be employed in combination with a repair putty that includes a resinous material and reinforcement fibers, but no ceramic constituents. In still further embodiments, a scrim having no ceramic constituents attached to it may by used and the repair putty may include only a resinous material.

The scrim may, in addition, provide a surface on which components such as, for example, the ceramic constituents may be attached. For instance, in some embodiments, an array of ceramic constituents may be arranged and directly attached to the scrim in a'single layer or multiple layers to form an "array sheet." The ceramic constituents may be arranged on the array sheet in any pattern to form a mosaic of ceramic constituents. For example, in some embodiments, the ceramic constituents may be arranged in a plurality of adjacent rows and columns such that each of the ceramic constituents in a row or column is aligned. In other embodiments, the ceramic constituents may be arranged in a hexagonal array such that each nugget or pellet has six immediate neighbors. In still other embodiments, the ceramic constituents may be arranged in a circular or spiral pattern such the ceramic constituents are arranged in one or more concentric circles. Other embodiments may include a plurality of ceramic constituents of varying sizes, shapes and materials arranged on the array sheet in any pattern including, but not limited to, rows and columns, hexagonal arrays or circular patterns. In some embodiments of the invention, adjacent ceramic constituents are touching, while in other embodiments, gaps are present between adjacent ceramic constituents. In still other embodiments, there is a combination of touching ceramic constituents and ceramic constituents with gaps between them. In further embodiments of the invention, the repair putty may contain ceramic constituents which may or may not be similar to the ceramic constituents attached to the array sheet that is applied as part of the repair procedure. For example, in some embodiments, the ceramic constituents of the repair putty may be smaller and/or have a different shape than the ceramic constituents attached to the array sheet.

Figure 2:
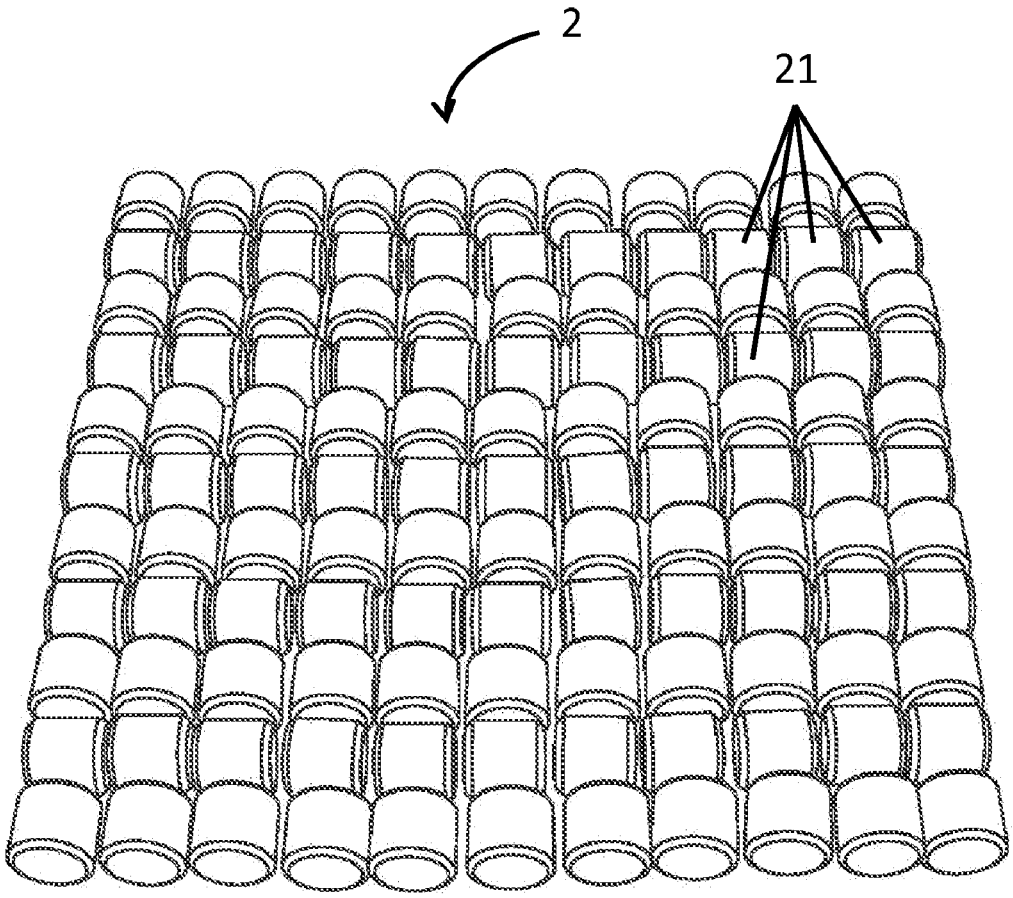
FIG. 2 is a photographic image of an array sheet having laterally-bonded ceramic nuggets attached to a fiberglass scrim.

The orientation of the ceramic constituents attached to an array sheet may additionally vary. For example, in some embodiments as shown in FIG. 1, cylindrical ceramic pellets 11 may be oriented such that they are standing on end to form an "end-bonded" array 1 (i.e., one circular face of the pellet is bonded to the scrim and the other circular face of the pellet is facing away from the scrim). Ceramic pellets oriented in this manner may be arranged in any of the patterns described above. In other embodiments such as those shown in FIG. 2, the ceramic pellets 21 may be oriented such that a lateral edge or side of the ceramic pellets are bonded to the scrim such that the circular faces of the pellet are perpendicular to the scrim to form a "laterally-bonded" array 2. In still other embodiments, both end-bonded and laterally-bonded ceramic pellets may be combined. Without wishing to be bound by theory, while end-bonded ceramic pellets may absorb the impact of a projectile or cause splitting, laterally-bonded pellets may provide glancing surfaces for incoming projectiles thereby absorbing a portion of the momentum and slowing the projectile or changing the direction or path of the projectile away from the repaired area of armor.

In particular, laterally-bonded ceramic pellets may be arranged in any pattern, such as in a row and column or hexagonal pattern. In some embodiments, the lateral orientation of the ceramic pellets may be in the form of a rectangular pattern in which one row is arranged in left to right orientation and the next row is arranged in an up and down orientation. In other embodiments, laterally-bonded ceramic pellets may be arranged in a fashion similar to bricks in a wall such that the intersection of neighboring ceramic pellets does not overlap between adjacent rows. In still other embodiments, every ceramic pellet is positioned in a different lateral orientation than each of its neighboring ceramic pellets to provide, for example, a herringbone or basketweave-type pattern. Numerous patterns for ceramic pellets in lateral orientation exist in the art and are encompassed by the invention.

Figure 3:
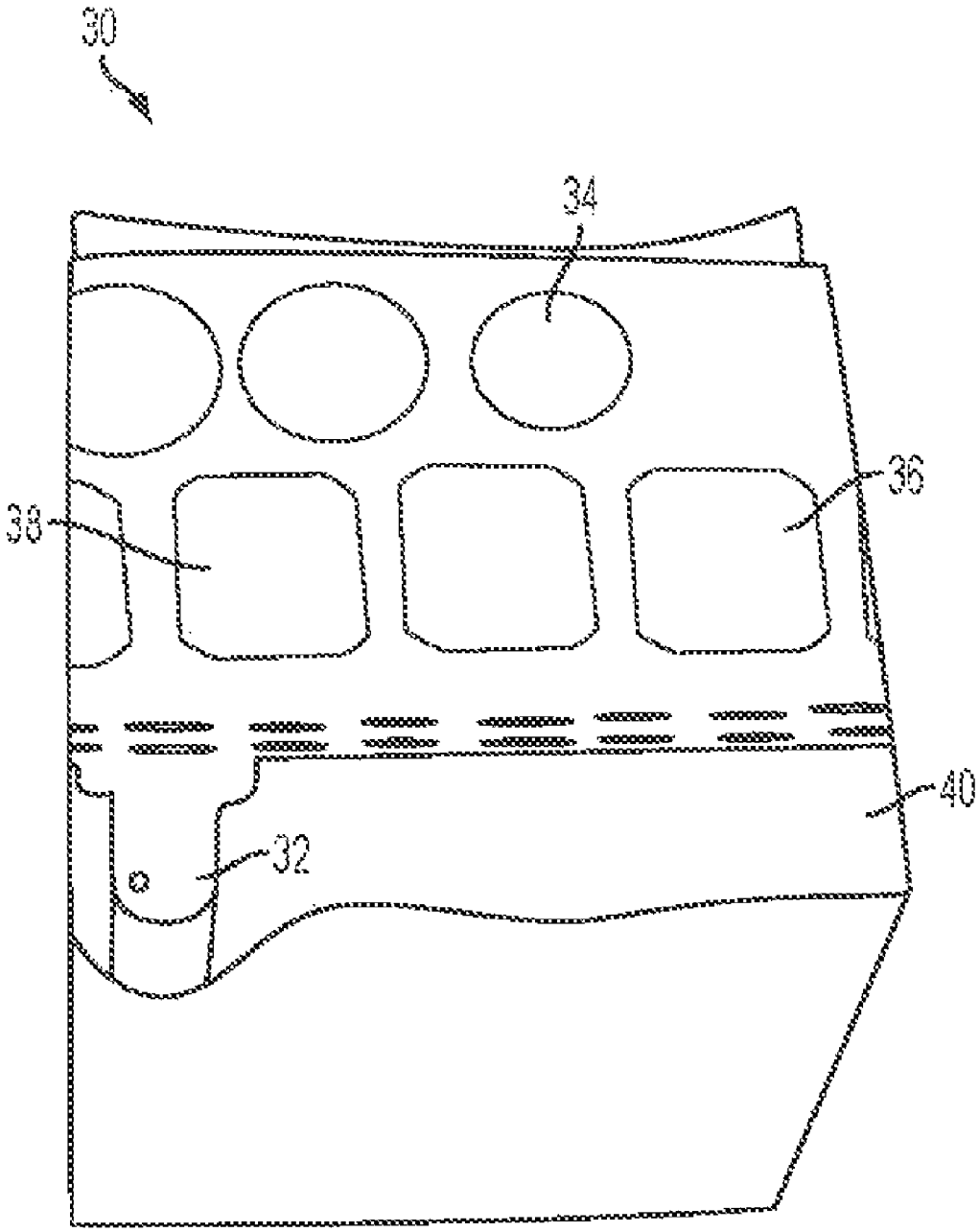
FIG. 3 is a photographic image of a section taken from an armor repair that illustrates the positioning of ceramic pellets and interstitial armor repair putty.

In various embodiments, two or more array sheets having ceramic constituents attached thereto may be applied to a damaged area over top of one another. Repair putty may be applied to individual array sheets, to layers of array sheets, between successive layers of array sheets or any combination thereof. In some embodiments where one or more array sheets including attached ceramic constituents may be applied to a repair, the ceramic constituents of each array sheet may be arranged in the same pattern or different pattern and in the same orientation or different orientation. For example, two or more array sheets each containing laterally-bonded ceramic pellets configured in the same pattern may be stacked and placed over a damaged area. In other embodiments, one or more array sheets containing end-bonded ceramic pellets may be applied to a damaged area and one or more array sheets containing laterally-bonded ceramic pellets may also be placed over the end-bonded array sheets or vice versa. FIG. 3 shows a cross-section of an armor repair 30 of damaged armor 32 in which two array sheets 34, 36 are emplaced on top of one another, the first array sheet 34 having end-bonded and the second array sheet 36 having laterally-bonded ceramic pellets. As shown in FIG. 3, the interstitial space between the pellets has been filled with armor repair putty 38. A shock-absorbing layer 40 is also shown in FIG. 3. In various embodiments of the invention, both the end-bonded ceramic pellets and the laterally-bonded ceramic pellets may be configured in any pattern described herein or otherwise known in the art.

The orientations and patterns of ceramic constituents on each array sheet applied to a damaged area may vary and may include any pattern known in the art. For example, in one embodiment, a first array sheet containing hexagonally arranged end-bonded ceramic pellets may be applied to a damaged area and a second array sheet containing laterally-bonded ceramic pellets in a rectangular pattern may be applied over the first array sheet. In another embodiment, the first array sheet may include laterally-bonded ceramic pellets in a column and row pattern and the second array sheet may contain laterally-bonded ceramic pellets in a herringbone pattern. In still further embodiments, the first array sheet may include laterally-bonded ceramic pellets in a circular pattern and the second array sheet may contain laterally-bonded ceramic pellets in a basketweave-type pattern.

In various embodiments incorporating array sheets, the positioning of the scrim may be varied to suit the circumstances of the repair. For example, in some embodiments where the damage to be repaired includes a surface concavity, the array sheet may be applied to the damaged area with the surface of the scrim having ceramic constituents attached thereto oriented to the outside and facing the damaging threat direction. In other embodiments, the surface of the scrim having ceramic constituents attached thereto may be oriented toward the damaged armor surface. In still other embodiments, two or more array sheets may be applied to the damaged armor surface such that the surfaces of the scrims with ceramic constituents attached are oriented toward the damaged surface, away from the damaged surface and toward the threat direction, or in various combinations of orientation as may be determined desirable for the particular repair circumstance.

In other embodiments of the invention, a buffer or shock-absorbing layer may be incorporated between the damaged armor and the repair putty, one or more scrims or array sheet layers. Examples of a shock-absorbing layer may include a neat resin having similar or identical formulation to the resinous material of the armor repair putty or a continuous or discontinuous fiber reinforced formulation of resinous material, among others. Without wishing to be bound by theory, the addition of fiber reinforcement to the shock-absorbing layer may improve the efficiency of the repair and/or improve the toughness of the shock-absorbing layer to resist delamination of the repair material from the damaged area. In various embodiments of the invention, a relatively thin shock-absorbing layer may be applied to the damaged armor prior to application of the armor repair putty. For example, in some embodiments, a shock-absorbing layer may be from about 1/10 inch (about 2.5 mm) to about ¼ (about 6.3 mm) inch thick.

Additional embodiments of the invention include a boundary frame or sub-frame, which may be secured to the area of damaged armor needing repair to provide a guide for the extent and thickness of the repair. The boundary frame or sub-frame may be used to locate, bound and contain armor repair elements (e.g., repair putty, array sheets and/or a shock-absorbing layer) in their desired position on a section of damaged or compromised armor, irrespective of the orientation and curvature of the armor surface, while the armor repair elements are curing or hardening. In some aspects of the invention, the boundary frame or sub-frame is fabricated from a material having a good degree of conformability to curved and irregular damaged armor surfaces such as, for example, elastomeric resin. The boundary frame and/or sub-frame may be attached to the damaged armor by means of a self-adhesive layer previously molded or otherwise attached to the boundary frame and/or sub-frame, by various separately applied adhesives or tapes, by the same resinous material used in the repair putty or by any of several mechanical means. In certain embodiments, the boundary frame and/or sub-frame may be provided with a self-adhesive layer that allows the boundary frame and/or sub-frame to adhere to the armor surfaces with sufficient strength to hold and contain the repair putty during application and curing or hardening. In other embodiments, an adhesive may be applied to the boundary frame/or sub-frame before it is applied to the armor surface. In still other embodiments, the boundary frame may be mechanically fastened to a previously secured studded sub-frame, which in turn is adhesively bonded to the damaged armor. Embodiments of the adhesive used in the various boundary frame and sub-frame embodiments may include any adhesive known in the art.

Various embodiments of the boundary frame and sub-frame may contain or may be formed to include any number of secondary elements that may aid in defining and/or maintaining boundaries, shape or cohesiveness of the repair. Such secondary elements are well known in the art, and any such secondary elements may be employed. In some embodiments, the height or thickness of the boundary wall may be sufficient to provide the desired thickness of armor repair putty, and in other embodiments, the boundary wall may contain an inward-directed flange designed to restrain the repair putty from falling out of alignment or slumping during the application and curing processes. The boundary frame of particular embodiments may be fabricated and packaged as a single unit such as, for example, a hoop or joined-square frame. In other embodiments, the boundary wall may be packaged as two or more individual sections or sub-frames that may be joined prior to being applied to the armor surface or may be joined during application such that each section is laid individually and joined on the armor surface. In addition, the boundary frame or sub-frame of embodiments of the invention may include a slotted frame or a studded frame or a combination thereof to facilitate placement and positioning of the boundary frame onto the damaged armor.

Figure 4:
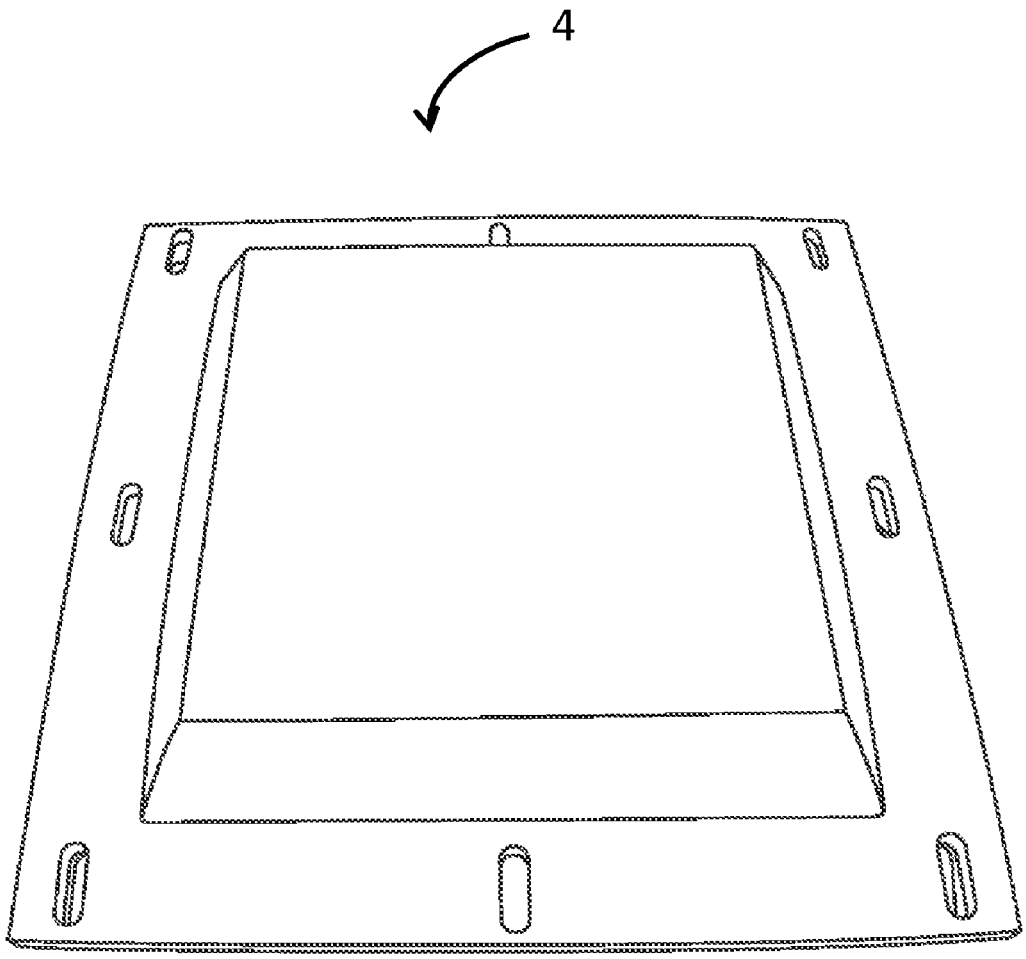
FIG. 4 is a photographic image of a rubber housing used to orient and contain armor repair elements during application and curing.
Figure 5:
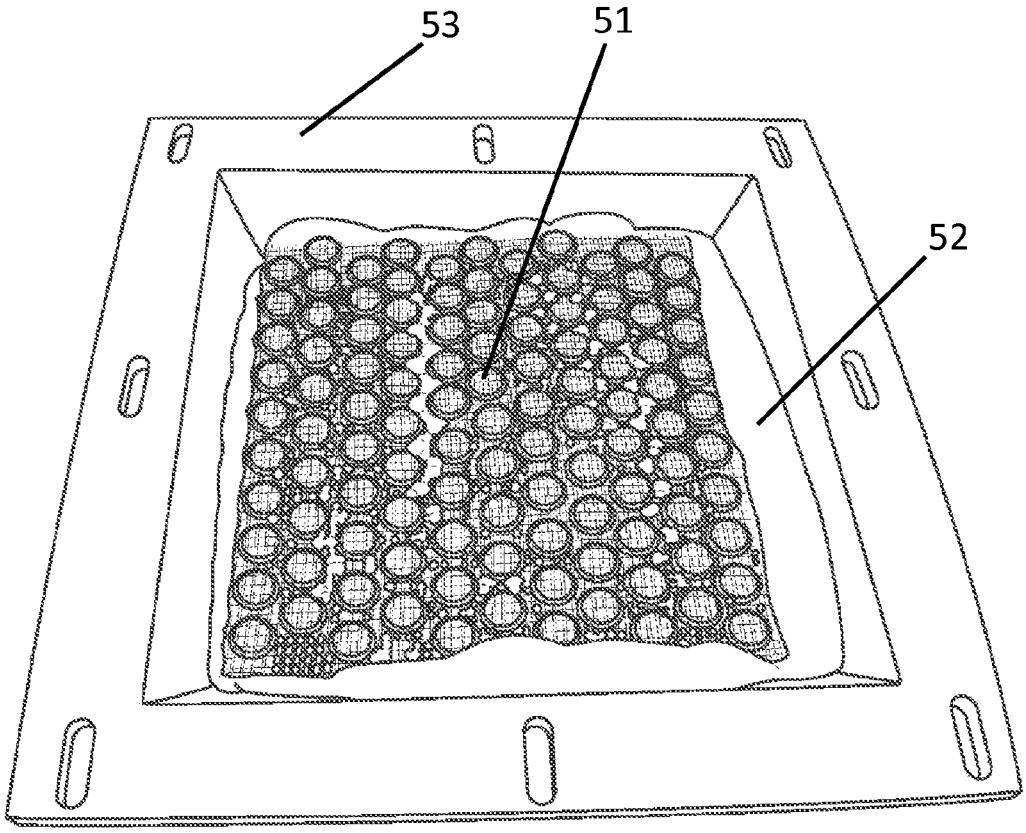
FIG. 5 is a photographic image of ceramic-containing scrims or array sheets positioned in a rubber housing and partially covered with armor repair putty.

Additional embodiments of the invention include a housing comprising rubber, elastomeric material or other resilient material, which may be coupled in an integrated fashion to the boundary frame to facilitate application of armor repair elements and provide consistency in armor repair methods. In some embodiments, the housing may provide a guide for the extent and thickness of the repair and may be used to locate, bound and contain armor repair elements (e.g., repair putty and array sheets) in their desired position and orientation on a section of damaged armor. FIG. 4 illustrates a rubber housing 4 configured to achieve said containment of the armor repair elements. In some embodiments, the housing serves as a vessel in which the armor repair putty (at any stage of curing) and/or the scrim or array sheet are positioned and oriented prior to application to the damaged armor surface. FIG. 5 illustrates one such embodiment, where ceramic-containing scrims or array sheets 51 and encapsulating resin 52 are positioned inside a rubber housing 53 prior to affixing the filled housing to the prepared damaged armor section.

The housing of embodiments of the invention may be fabricated from any material having a good degree of conformability to curved and irregular surfaces. Various embodiments of the housing may contain or may be formed to include any number of secondary elements that may aid in defining and/or maintaining boundaries, shape or cohesiveness of the repair. The housing of various embodiments may be attached to the boundary frame or sub-frame by means of a self-adhesive layer previously molded or otherwise attached to the housing or the boundary frame and/or sub-frame, by separately applied adhesives or tapes, or by any of several mechanical means. In certain embodiments, the housing is positioned between a studded frame and a slotted frame, which interlock to hold the housing in place over the damaged area. In such embodiments, the studded frame may have been previously secured to the damaged armor by adhesive or mechanical means.

Further embodiments of the invention include repair disks, which add structural support and enhance the structural integrity of the damaged armor. The repair disks of various embodiments may be of any size, shape or thickness and may be comprised of any material known in the art, such as, for example, steel or composite materials. In some embodiments, the repair disk is flat. In other embodiments, the repair disk is curved or contoured to specific surface to be repaired. Further, a repair disk that is provided in some standard curved configuration may be easily recontoured to other surface curvatures that may be encountered in practice using simple tools normally available to unit maintenance personnel.

Certain embodiments of the invention further include a covering that may be placed over the damaged armor following the repair. Such coverings may include any type of covering material known in the art, such as, for example, a fabric or plastic sheet, and in certain embodiments the covering may be colored or dyed in any manner. For example, the covering may be a solid color, such as, for example, black, tan, brown or silver, and in other embodiments, the covering may be multiple colors or patterned to resemble, for example, camouflage. In some embodiments, the covering may merely provide a means for coloring the repair to resemble the surrounding material. In other embodiments, the covering may provide an additional structural layer that, for example, inhibits lateral movement of the repair putty or components thereof or reduces cracking or fragmenting of the repair following curing. The covering of certain embodiments may be applied and may adhere to uncured repair putty based on the inherent tackiness of the repair putty, and in other embodiments, the covering may be applied to the repair with an adhesive, which may allow the covering to adhere to the cured or uncured repair putty as well as non-damaged armor surrounding the damaged area. In some embodiments, the covering may incorporate a pressure sensitive adhesive on one surface, requiring only the removal of a backing sheet to permit reliable adhesion to the finished repair. In particular embodiments, the covering may otherwise include an adhesive layer that is activated before use by, for example, wetting or heating the adhesive layer.

Various embodiments of the invention are directed to methods for repairing damaged armor on vehicles or other protected structures. Such embodiments encompass any arrangement or combination of any of the armor repair elements disclosed herein. For example, in some embodiments, a repair putty may be prepared by mixing a resinous material with ceramic constituents and fiber reinforcements. This repair putty may be applied directly to the damaged armor and the repair putty may be cured or otherwise hardened. In these embodiments, the resinous material may adhere directly to the damaged armor that remains attached as well as to the non-damaged armor surrounding the damaged area. Without wishing to be bound by theory, the ceramic constituents may minimize the impact of a damaging threat or projectile and the fiber reinforcement may improve structural integrity for the cured resinous material, restrain movement of the ceramic components, minimize cracking and local strain on the cured resin and the like. The repair putty in such embodiments may be applied at any thickness, and the thickness of the applied repair putty may vary depending on, for example, the given threat scenario. For example, in some embodiments, the thickness of the repair putty may be sufficient to encompass at least about two times the largest dimension of an included ceramic constituent. Without wishing to be bound by theory, this minimum thickness guarantees that applied repair putty will introduce intersections with at least one hard ceramic constituent, and likely several, for any incoming projectile to the repair.

In other embodiments, the method for repairing armor may include the step of applying one or more additional resinous material layers or shock-absorbing layers to the damaged armor or non-damaged armor surrounding the damaged armor prior to the application of the repair putty. Similarly, one or more additional resinous material layers may be applied after the repair putty has been applied and, in some cases, after the repair putty has been cured. The resinous material of these additional layers may or may not include ceramic constituents and/or fiber reinforcements and may or may not be prepared using the same resinous material as in the repair putty. Without wishing to be bound by theory, the additional resinous material layers or shock-absorbing layers may provide improved bonding between the repair putty and the armor to be repaired or a protective covering layer. In addition, the resinous material layers or shock-absorbing layers, whether unreinforced or reinforced with random or aligned woven or nonwoven fabrics, may provide a shock-absorbing or buffering function to minimize separation or delamination of the repair putty from the damaged armor surface when subject to attack by the damaging threats. In other cases, the resinous material layers or shock-absorbing layers applied on top of the repair putty may provide a hard finish coat that resists cracking or protects the cured or otherwise hardened repair putty from environmental damage.

In still other embodiments, the methods for repairing armor may include the step of applying a scrim to the damaged area prior to application of the repair putty, after application of the repair putty or as an intermediate step between applying layers of repair putty, such that a scrim may make up an intermediate layer between layers of repair putty. The scrim of such embodiments may include an adhesive layer that is pre-bonded or otherwise coupled to the scrim to facilitate bonding of the scrim to the damaged armor or to the non-damaged areas surrounding the damaged armor. In some embodiments, the adhesive layer may need to be activated by, for example, wetting, heating or removing a covering over the adhesive before the scrim is applied. In other embodiments, one or more additional resinous material layers or shock-absorbing layers such as those described above or a separate adhesive layer may be applied to the damaged armor to facilitate bonding of the scrim.

In certain embodiments, the methods of the invention may include the step of applying one or more array sheets to the damaged armor. For example, in some embodiments, one or more array sheets may be applied to a damaged armor prior to addition of repair putty. In some such embodiments, the array sheets may include an adhesive layer that is pre-bonded to the array sheet or the scrim associated with the array sheet, which facilitates bonding of the array sheet. As described above, the adhesive layer may require activation by, for example, wetting, heating or removing a covering over the adhesive before the array sheet is bonded to the damaged armor or to areas of non-damaged armor surrounding the damaged area. In other embodiments, a layer of repair putty, an additional resinous material layer or shock-absorbing layer and/or a separate adhesive layer may be applied to facilitate application of the array sheet to the damaged area.

Following the application of one or more array sheets, one or more layers of repair putty may be spread over the array sheets and the repair putty may be cured or otherwise hardened. The arrangement of the array sheets and the repair putty layers may vary and can be altered depending on the specific repair required. For example, in one embodiment, an array sheet may be bonded to the damaged area with an adhesive and a layer of repair putty may be spread over the array sheet and then cured to complete the repair. In another embodiment, a base layer of repair putty may be applied to the damaged area followed by an array sheet and a second repair putty layer, and in yet another embodiment, a base repair putty layer may be applied followed by a first array sheet, a second repair putty layer, a second array sheet and a final repair putty layer. In still further embodiments, a scrim may be applied over a base layer or intermediate layer of repair putty and/or before or after the application of an array sheet, and in further embodiments, an additional resinous layer or shock-absorbing layer may be applied before or after the application of an array sheet, scrim and/or repair putty layer, between repair putty layers, between array sheet layers or array sheet and repair putty layers, over the repaired armor or any combination thereof. In like fashion, and incorporating as required the various embodiments described herein, additional array sheets, repair putty, and/or scrim layers may be stacked in sequence to the number necessary to provide the protection desired with respect to potential damaging threats.

Figure 6:
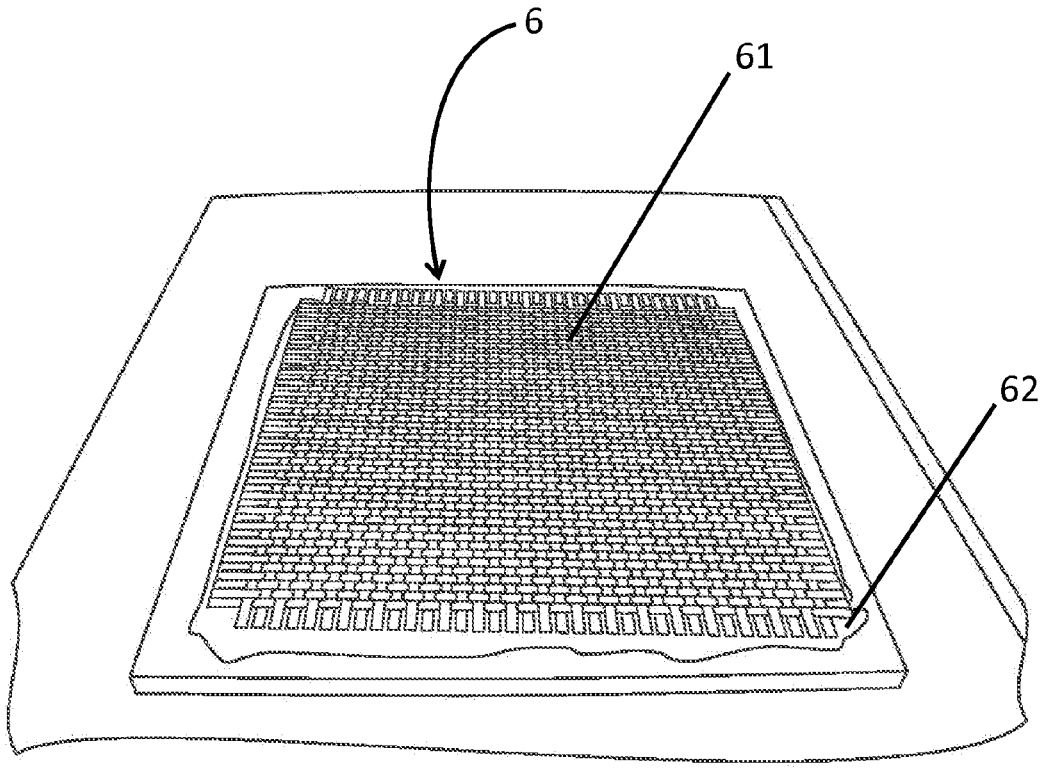
FIG. 6 is a photographic image of a second sheet of fiberglass fabric applied to a thin layer of resin and previously applied first sheet of fiberglass fabric, forming a shock-absorbing layer.
Figure 7:
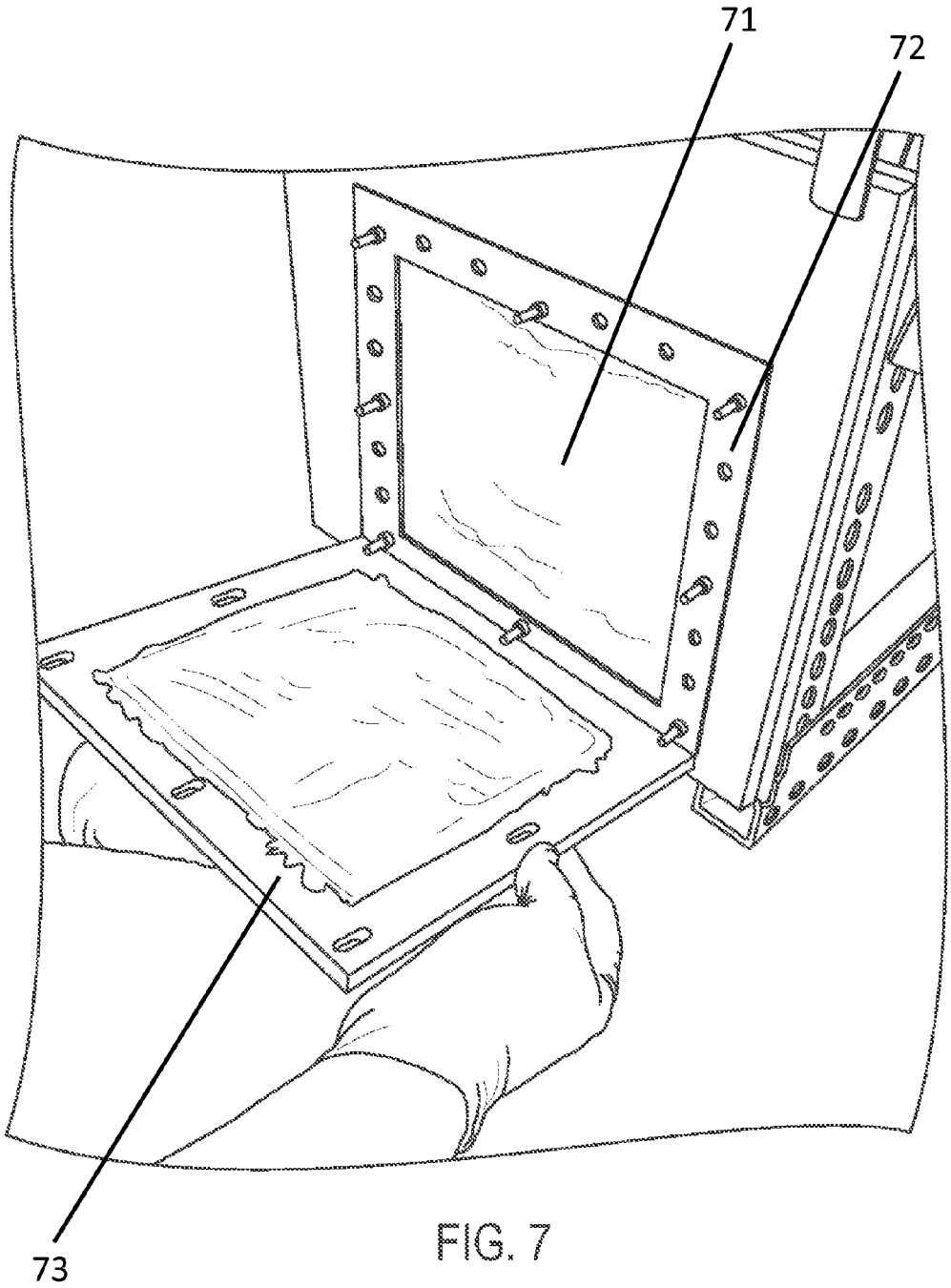
FIG. 7 is a photographic image of a shock-absorbing layer with attached studded boundary frame, as well as a rubber housing containing two ceramic-containing scrims or array sheets and a measured amount of armor repair putty.

Other embodiments of the armor repair methods may include the application of shock-absorbing layers and a studded sub-frame to the damaged armor in order to prepare the armor surface for application of one or more armor repair elements that have been separately prepared and enclosed within a housing. FIG. 6 illustrates the application of a shock-absorbing layer 6 comprising two fiberglass fabric sheets 61 and a measured amount of armor repair putty 62. Once the resinous material comprising the shock-absorbing layer 6 and adhering the studded sub-frame to the damaged armor has cured to the point of supporting the weight of the armor repair, a rubber housing with prepared armor repair elements may be mechanically fastened to the studded frame. FIG. 7 illustrates a completed shock-absorbing layer 71 and bonded studded sub-frame 72 along with a separately prepared repair contained within a rubber housing 73. The studded sub-frame 72 has been sufficiently bonded to the damaged armor such that the as-yet incompletely cured repair material in the rubber housing 73 may be easily mechanically fastened to the studded sub-frame 72 and bonded to the shock-absorbing layer 71.

Methods of certain embodiments may include the step of applying a covering to the repaired armor. For example, in some embodiments, a covering may be applied to a repair before the repair putty has cured. In such embodiments, the resin may secure the covering to the repaired armor without the need for additional adhesives. In other embodiments, the covering may be applied after the repair putty has cured or otherwise hardened and an adhesive may be used to adhere the covering to the repaired armor. In still other embodiments, a covering may be applied to a housing used as previously described to facilitate application of the armor repair elements.

Once applied, the armor repair putty may be cured or otherwise hardened by any method known in the art, such as, for example, air drying, heating, irradiating with electromagnetic energy, blow drying, and the like, or combinations thereof. In some embodiments, the repair putty is cured using a heat gun or other handheld heat generating device. In particular embodiments, curing may occur at ambient temperature without any other aid, so as to minimize the need for equipment or other logistical requirements. In particular embodiments, different methods may be used to cure or harden the shock-absorbing layer and the armor repair putty, whether contained within a housing or applied to the damaged armor without housing or boundary frame. For example, in some embodiments, a heat gun may be used to rapidly cure the shock-absorbing layer and any attached sub-frame or boundary frame. The balance of the repair may then be allowed to cure naturally at ambient temperature. Alternative methods of curing may be used in depot or other equipped repair locations in order to increase the throughput and/or complexity of repairs achievable by use of the repair putty. In particular embodiments, during or following curing, the repair putty may be finished by smoothing the surface and, for example, painting or sealing with polymer resin.

Various embodiments of the methods of the invention may further include preparing the area to which the armor repair putty or other armor repair element is to be applied. For example, in some embodiments, the area to which the armor repair putty or other armor repair element is to be applied may be cleaned by, for example, washing the area with water and/or soap, cleansers or abrasives. In addition, compressed air may be used to remove loose dirt or other particulate matter from the surface to be repaired. In other embodiments, the area to which the armor repair putty or other armor repair element is treated with a chemical solvent to remove, for example, paint or varnish. In yet other embodiments, no preparation of the surface may be required, excepting only removal of loose debris from the surface.

Various embodiments of the invention are directed to methods for enhancing nondamaged armor. In particular, in some embodiments, the armor repair putty may be applied to a surface of an undamaged armor to enhance the effectiveness of the armor. For example, the armor repair putty may be applied to gaps between armor plates on, for example, the body of a wheeled vehicle or tank, or a layer of the armor repair putty may be applied to an armored or unarmored surface of any type to provide an extra layer of protection against damaging threats and other projectiles. In other embodiments, the armor repair putty may be used to enhance the ballistic protection afforded by fixed structures such as guard shelters at checkpoints, personnel billeting areas, mess areas or any building space where the basic construction provides little or no protection from ballistic threats.

The invention described herein also encompasses armor repair kits including one or more armor repair elements including, for example, repair putty, scrim, array sheet, shock-absorbing materials, boundary frames, rubber housing, metallic and non-metallic repair disks and coverings. The armor repair kits may further include items such as, for example, a drop sheet or cloth, latex gloves, paper towels, tools for mixing such as mixing cups and mixing sticks, tools for applying the putty such as a squeegee, paint brush or spatula, tools for curing the resinous material such as a heat gun or other handheld heat generating device, implements for cleaning the damaged armor, such as, scrubbers, abrasives, cleaning agents and the like, and coloring agents, such as paint, and the like.

In particular embodiments, the armor repair putty may be separated into various components and stored individually within a kit. For example, the resinous material, reinforcement fibers and ceramic nuggets may be premixed and stored as one component and a curing agent may be separately stored in a second container. In such embodiments, the curing agent may be combined with the other components prior to use. In some embodiments, the constituent materials of the armor repair putty (e.g., the resinous material, ceramic constituents, reinforcement fibers and so on) may be stored in pre-measured proportions within individual sealed containers, and the individual containers may be stored in a larger container, which may additionally serve as the mixing vessel. The individual containers may be of any design. For example, in one embodiment, the individual containers may be combined into one or more tube-shaped heavy gage plastic bags that have a mechanical separator interposed between distinct volumes in the bag sized to contain the appropriate proportions of the resin formulation. In use, the mechanical separator can be removed and the two components of the resin system can be manually kneaded or mixed within the plastic tube or bag until the components are thoroughly mixed. In some embodiments, a colorant additive may be used to assure appropriate mixing such that a desired uniform hue is achieved when the components are properly mixed. The other constituents in this implementation (reinforcing fiber and ceramic nuggets) may likewise be packaged in pre-measured plastic containers such as bags or more rigid receptacles. The constituent materials of the armor repair putty may be mixed by any method known in the art, such as, for example, hand mixer, spatulas, stiff paint-mixing sticks or a mechanical mixer. The mixed armor repair putty may be applied using any manual or mechanical means known in the art. For example, the putty may be applied using one's gloved hands, a trowel, a spatula or the like.

Kits of various embodiments may include any number of tools necessary for mixing, applying and curing the repair putty, as well as such housing, frame and sub-frame elements as may be found expedient. For example, an armor repair kit may include a container for mixing the putty material, one or more mixing utensils, such as, for example, a hand stirrer or mechanical mixing device, one or more application tools, such as, for example, a squeegee, paint brush, trowel or spatula and a device for curing the resinous material, such as, for example, a heat gun or other handheld heat generating device or a battery powered UV light. In other embodiments, the kit may include materials for preparing the surface of the damaged armor prior to repair. For example, an armor repair kit may include solvents, liquids, cleansers, soaps and the like for cleaning the surface of the armor as well as a brush, scouring pad, sand paper or cloth. In still other embodiments, the kit may contain a boundary frame and/or housing, studded attachment frame, slotted clamping frame and any elements thereof which may tend to optimize the uniformity and reliability of the repair.

In certain embodiments, the kit may be a self-contained kit such that it may be easily transported and stowed. For example, the armor repair kit may include a container into which all of the components of the kit are placed. The container may be sealed to improve the shelf life of the armor repair kit. In various embodiments, a sealed, self-contained armor repair kit may have a shelf life of from about 6 months to about 10 years, and for example, a package of about ⅛ cubic foot (a cube six inches on each side) may be used to repair an area approximately six inches square (about 36 square inches) by approximately 1 inch thick.

The kit may further include an instruction sheet that outlines the procedural steps of the methods, and will follow substantially the same procedures as described herein or are known to those of ordinary skill. The instruction information may be in a computer readable media containing machine-readable instructions that, when executed using a computer, cause the display of a real or virtual procedures for repairing damaged armor. The instruction information may also be provided on illustrated and weatherproofed cards of single-page, multi-page, and/or folded configuration. In certain embodiments, the material safety data sheets (MSDS) for the some or all of the components of the kit are also included in the kit.

EXAMPLES

In order that the invention disclosed herein may be more efficiently understood, the following examples are provided. These examples are for illustrative purposes only and are not to be construed as limiting the invention in any manner.

Example 1

Armor Repair of Small Penetrations

For armor damaged by penetrations (e.g., holes) smaller than the largest ceramic constituents included within the putty formulation (including generally holes of ½ inch or lesser diameter) the armor repair putty may be applied over the perforated surface to be repaired, relying on the multiplicity of ceramic constituents that must necessarily be encountered by an incoming bullet or projectile to eliminate the possibility of a projectile passing through the perforations caused by the prior damage being repaired.

In a particular implementation, a ⅜ inch thick Rolled Homogeneous Armor (RHA) plate, such as would be typically be applied to light tactical wheeled vehicles or trucks, and is proof against 7.62×54 mm LPS ammunition, was perforated by a multiplicity of 0.30 inch and 0.50 inch holes using small arms projectiles that overmatched the protection afforded by the ⅜ inch thickness of the RHA plate. The RHA plate so perforated was repaired by applying a 1.5 inch layer of repair putty consisting of approximately 70% volume fraction of alumina ceramic nuggets of about ⅜ inch diameter, encapsulated in a methyl-methacrylate resin with approximately 5% by weight of chopped basalt reinforcing fiber. This repair was tested by being shot with multiple projectiles of 7.62×63 mm armor-piercing ammunition, which all failed to penetrate the repaired RHA plate, even when some of the strikes were closely co-located with the prior perforation damage. The 7.62×63 mm armor-piercing ammunition used in this test would greatly overmatch the protection capability of the bare ⅜ inch thick RHA plate, and the indicated putty repair therefore not only repaired the small caliber perforations in the RHA plate, but also considerably enhanced the protection level of the armor. Additional ballistic testing of nearly identical ⅜ inch thick RHA plates repaired or augmented in the same fashion as described above indicated that the 1.5 inch layer of repair putty applied to ⅜ inch thick RHA plate provided protection against 12.7×99 mm (0.50 caliber Browning) ball ammunition, which would greatly overmatch the protection capability of bare ⅜ inch thick RHA.

Example 2

Armor Repair of Large Penetrations

As an example of the use of the armor repair putty in armor damaged by a hole larger than any reasonably contemplated ceramic constituent, a ¼ inch thick Rolled Homogeneous Armor (RHA) plate, as would be typically be applied to light tactical vehicles to provide protection against 7.62×39 mm ball ammunition, such as is fired by the AK-47 series of assault rifles, was penetrated by a large fragment causing a hole 3 inches in diameter. The hole was repaired by first adhesively bonding a ⅛ inch thick high hardness steel cover plate of 5 inch diameter over the hole. A 1.5 inch layer of the armor repair putty described in Example 1 was applied over the plate. The resulting repaired surface was tested against 7.62×54 mm LPS ammunition, which would normally penetrate the bare ¼ inch thick RHA plate with ease, as well as the ⅛ inch thick high hardness steel cover plate. The repaired ¼ inch thick RHA plate stopped numerous 7.62×54 mm LPS bullets, including at least one impacting directly over the 3 inch hole. The presence of the armor repair putty not only successfully repaired the 3 inch diameter hole, but also increased the protection level of the undamaged ¼ inch thick RHA plate considerably.

Example 3

Armor Repair of Large Non-Penetrating Gouges

In cases where a thick plate of aluminum armor is damaged by large non-penetrating gouges caused by glancing blows from high-energy fragments, the armor repair putty is also effective as demonstrated by the following example. An armor plate of 2 inch thick 5083 aluminum was damaged by machining out four separate inch square gouges having dimensions penetrating to approximately 1 inch, 1.25 inch, 1.50 inch, and 1.75 inch depths, leaving approximately 1 inch, 0.75 inch, 0.50 inch, and 0.25 inch remaining thicknesses, respectively. Each of the gouges was repaired by filling the respective cavity with the armor repair putty described in Example 1. Each of the gouged areas was further coated with an additional 1 inch thick layer of the repair putty. All of the so-described and repaired damaged areas in the aluminum armor plate were subsequently attacked by 12.7×99 mm (0.50 Browning) M33 Ball ammunition at muzzle velocity, a projectile that significantly overmatches the approximately 2 inch thick aluminum armor plate. Each of the repaired cavities stopped the normally overmatching threat, save one, the simulated damage in which only 0.25 inch of aluminum thickness remained split from the remainder of the plate along three edges, and allowed a low velocity threshold penetration. This repair performance demonstrates the versatility of the repair putty for rehabilitating armor damage of various types on several distinct types of armor.

Example 4

Flat Vertical Surface Armor Repair

The following example demonstrates methods for the repair of flat vertical armor surfaces. Initially, the flat vertical armor surface of aluminum armor, including remaining damaged armor and non-damaged armor surrounding a penetration of approximately 3 inches in diameter, was prepared by grinding the raised areas around the penetration so that the surface was flush. A wire brush was then used to loosen dirt and debris and the surface was treated with a chemical solvent to remove any remaining dirt or particulate matter. The repair area was then heated using a handheld heat gun to facilitate application of repair putty.

The components of the repair putty were combined and mixed thoroughly using a mixing stick. The repair putty was then spread in an approximately 0.01 inch thickness over a 10 inch×10 inch area encompassing the 3 inch penetration. A single sheet of fiberglass was then applied on top of the repair putty using a squeegee and second 0.01 inch thick layer of the repair putty was applied on top of the fiberglass sheet, partially wetting into the fiberglass fabric. A round steel repair disk about 5 inches in diameter was heated until hot to the touch using the heat gun and adhesive was spread over one side of the heated steel repair disk. The adhesive side of the steel repair disk was then applied on top of the second layer of repair putty over the area in which the 3 inch penetration was located. The steel disk was held in place using the mixing stick while the repair area was heated using the heat gun. Once repair putty was cured to the extent the steel disk was bonded in place, a second sheet of fiberglass was applied over the steel disk and third 0.01 inch thick layer of the repair putty was applied on top of the second fiberglass sheet, again partially wetting the fiberglass fabric. A studded boundary frame was then positioned around the repair area and the studded boundary frame was oriented with center studs positioned above and below the 3 inch penetration, so that the boundary frame was symmetrically located with respect to the penetration. The studded boundary frame was pressed into the third layer of repair putty and the heat gun was applied to ensure bonding.

A new batch of repair putty was prepared and poured evenly into a slotted rubber housing. The array sheet was then placed in the rubber housing and pressed into the repair putty to ensure that every ceramic constituent attached to the array sheet was surrounded by repair putty. A ¼ inch layer of repair putty was then applied on top of the array sheet in the rubber housing. A second array sheet was applied onto the exposed resin layer and worked into the resin so that the interstitial spaces between array sheet ceramic constituents were filled with resin. An additional layer of the resinous repair putty was applied to the exposed surface of the second array sheet to an approximate thickness of ¼ inch. The slotted rubber housing and its contents were then placed into a slotted frame, with slotted in alignment. The rubber housing and slotted frame were then rotated onto the studded frame, with the studs passing through the slots of the rubber housing and slotted frame, as shown in FIG. 7. The rubber housing and slotted frame were mechanically fastened to the studded boundary frame using speed nuts and the repair area was allowed to cure. This repaired armor plate was subsequently shot with five rounds of 0.30-'06 armor piercing ammunition, with no penetrations of the repaired area observed, though some excavation of the repair material by the shots was noted.

Example 5

Curved Surface Armor Repair

The following example demonstrates methods for the repair of curved armor surfaces. The surface of 0.125 inch thick curved aluminum armor in need of repair was prepared as described in Example 4. Following such preparation, a studded boundary frame and a curved steel repair disk were bent and adjusted to match the topography of the curved surface in need of repair. These parts were then set aside. The components of the armor repair putty were combined and mixed thoroughly using a mixing stick. The repair putty was spread in an approximately 0.01 inch thick layer over a 10 inch×10 inch area encompassing a 3 inch penetration. A single sheet of fiberglass was applied on top of the repair putty using a squeegee and second 0.01 inch thick layer of the repair putty was applied on top of the fiberglass sheet, partially wetting into the fiberglass fabric. Adhesive was spread over one side of the bent repair disk and the repair area. The adhesive side of the repair disk was applied on top of the second layer of repair putty over the area in which the penetration was located. The repair disk was held in place using the mixing stick while the repair area cured using a handheld heat gun. Once repair putty was cured to the extent the repair disk was bonded in place, a second sheet of fiberglass was applied over the repair disk and third 0.01 inch thick layer of the repair putty was applied on top of the second fiberglass sheet, partially wetting into the fiberglass fabric. The bent studded boundary frame was then positioned into the repair putty around the repair area and further adjusted so as to closely conform to the curved repair surface and shock-absorbing layer. The studded boundary frame was pressed into contact with the exposed resinous surface of the shock-absorbing layer, the heat gun was used to ensure bonding, and the repair putty was allowed to cure at ambient temperature for about 1 hour.

Figure 8:
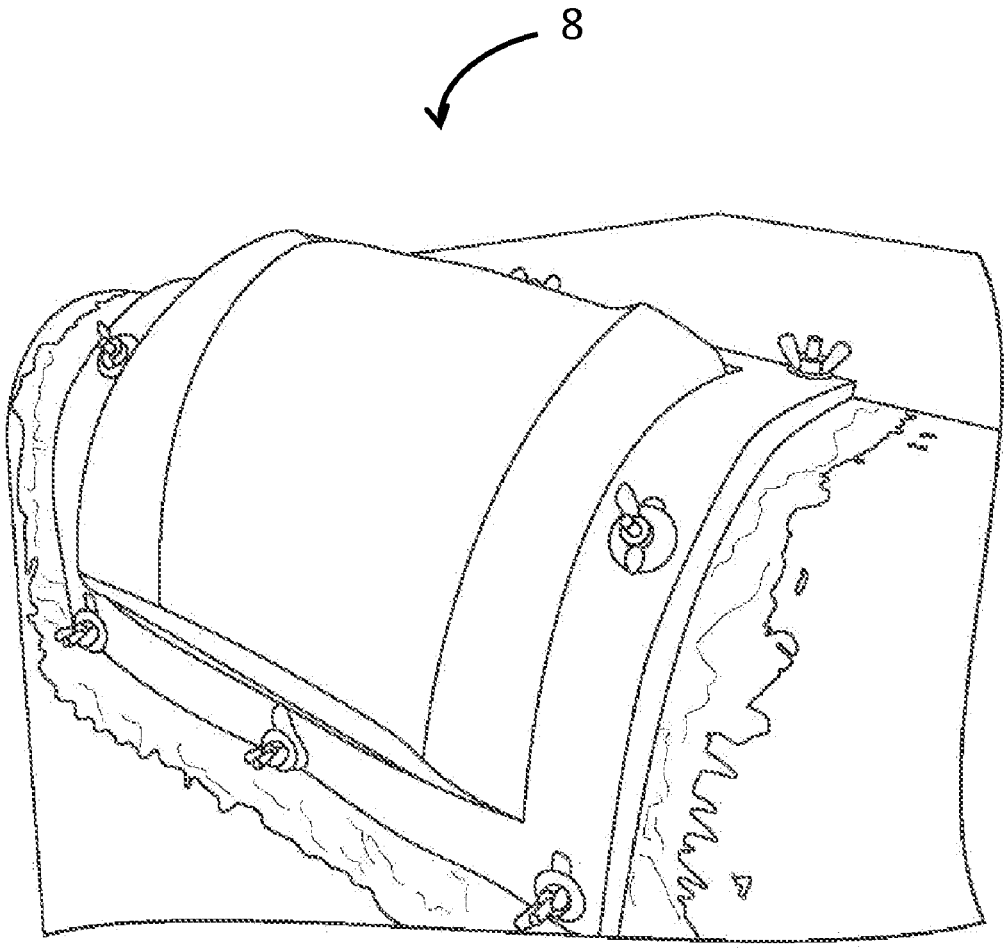
FIG. 8 is a photographic image of a completed repair of a curved armor surface.

A new batch of armor repair putty was prepared and poured evenly into a slotted rubber housing. A first array sheet was placed in the rubber housing and pressed into the repair putty to ensure that every ceramic constituent attached to the array sheet was surrounded by repair putty. A ¼ inch layer of repair putty was then applied on top of the first array sheet positioned in the rubber housing. A second array sheet was positioned over the first array sheet in the rubber housing and an additional ¼ inch layer of repair putty was administered on top of the first layer until the interstitial spaces between ceramic elements were filled with repair putty. The slotted rubber housing and its contents were then placed into a slotted frame, with slotted holes in both housing and frame positioned in alignment. The rubber housing and slotted frame were then rotated onto the studded frame, with the studs passing through the slots of the rubber housing and slotted frame. The rubber housing and slotted frame were mechanically fastened to the slotted frame using speed nuts and the repair area was allowed to cure. The completed curved repair 8 is shown in FIG. 8, illustrating the degree to which the armor repair kit and methods related thereto can accommodate variations in damaged armor shapes. The repaired curved armor surface 8 was shot by three rounds of 0.30-'06 armor piercing ammunition without penetration of the repaired area. The 0.30-'06 armor piercing ammunition greatly overmatches the original curved metallic surface being repaired, which was 0.125 inch thick aluminum. The non-penetration of this repair by such ammunition indicates the value of the repair kit and method for both repairing damaged armor and structures and improving the protective capacity of these structures.

Various modifications of the invention, in addition to those described herein, will be apparent to those skilled in the art from the foregoing description. Such modifications are intended to fall within the scope of the appended claims.

What is claimed is:

1. An armor repair kit comprising:

an armor repair putty comprising a resinous material;

one or more scrims having a plurality of ceramic constituents fixedly attached thereto;

and an elastomeric housing.

2. The armor repair kit of claim 1, wherein the armor repair putty further comprises a plurality of ceramic constituents.

3. The armor repair kit of claim 1, wherein the armor repair putty further comprises a plurality of reinforcement fibers.

4. The armor repair kit of claim 1, wherein the armor repair putty is partially pre-cured.

5. The armor repair kit of claim 1, further comprising a shock-absorbing material layer.

6. The armor repair kit of claim 1, further comprising a repair disk.

7. The armor repair kit of claim 1, further comprising a boundary frame, wherein the boundary frame comprises conformable material.

8. The armor repair kit of claim 1, further comprising a studded sub-frame and slotted sub-frame, wherein portions of the studded sub-frame and portions of the slotted sub-frame are capable of being joined together using a mechanical fastener.

9. The armor repair kit of claim 1, further comprising a handheld tool for mixing the armor repair putty.

10. The armor repair kit of claim 1, further comprising a handheld tool for applying the armor repair putty.

11. The armor repair kit of claim 1, further comprising a handheld tool for curing the armor repair putty.

* * * * *